US007665300B2

(12) United States Patent
Biggs et al.

(10) Patent No.: US 7,665,300 B2
(45) Date of Patent: Feb. 23, 2010

(54) THIN, FLEXIBLE ACTUATOR ARRAY TO PRODUCE COMPLEX SHAPES AND FORCE DISTRIBUTIONS

(75) Inventors: S. James Biggs, Cambridge, MA (US); R. Dodge Daverman, Boston, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 836 days.

(21) Appl. No.: 11/078,195

(22) Filed: Mar. 11, 2005

(65) Prior Publication Data

US 2006/0201149 A1 Sep. 14, 2006

(51) Int. Cl.
*F01B 29/10* (2006.01)

(52) U.S. Cl. ..... 60/528; 60/529

(58) Field of Classification Search ..... 60/527–529
See application file for complete search history.

(56) References Cited

U.S. PATENT DOCUMENTS

| | | | | |
|---|---|---|---|---|
| 2,629,791 | A | 2/1953 | Le Tourneau | |
| 3,941,953 | A | 3/1976 | Misson et al. | |
| 4,209,675 | A | 6/1980 | Vitale | |
| 4,716,262 | A | 12/1987 | Morse | |
| 4,790,353 | A | 12/1988 | Hastings et al. | |
| 4,795,458 | A | 1/1989 | Regan | |
| 4,822,959 | A | 4/1989 | Schwab | |
| 5,029,805 | A * | 7/1991 | Albarda et al. | 251/11 |
| 5,058,856 | A * | 10/1991 | Gordon et al. | 251/11 |
| 5,410,290 | A | 4/1995 | Cho | |
| 5,563,458 | A | 10/1996 | Ericson | |
| 5,601,280 | A | 2/1997 | Nagaya et al. | |
| 5,679,216 | A | 10/1997 | Takayama et al. | |
| 5,796,152 | A * | 8/1998 | Carr et al. | 257/415 |
| 5,799,871 | A | 9/1998 | Theurer | |
| 5,996,346 | A | 12/1999 | Maynard | |

(Continued)

FOREIGN PATENT DOCUMENTS

DE 29816878 U1 12/1998

(Continued)

OTHER PUBLICATIONS

Nakamura, M. and Jones, L, "An actuator for the tactile vest—a torso-based paptic device,"—Proceedings of 11$^{th}$ Symposium on Haptic Interfaces for Virtual Environment and Teleoperator Systems. Haptics 2003 (pp. 333-339). 7780494 INSPEC (Abstract No. C2003-12-5540B-019.).

(Continued)

*Primary Examiner*—Hoang M Nguyen
(74) *Attorney, Agent, or Firm*—Hamilton, Brook, Smith & Reynolds, P.C.

(57) ABSTRACT

An actuator includes a bistable mechanism having a tension beam and a compression beam defined by a relief slit in a flexible substrate; and a first shape memory element that upon heating actuates the actuator from a first position to a second position. A heat source can be thermally coupled to actuate the first shape memory element, or the first shape memory element can be heated by passing current through the element. The actuators can be formed in an array. Such arrays can be useful for tactile displays, massagers, and the like. Also included are methods of operation and manufacturing.

29 Claims, 15 Drawing Sheets

U.S. PATENT DOCUMENTS

| | | | | |
|---|---|---|---|---|
| 6,194,066 | B1 | 2/2001 | Hoffman | |
| 6,236,300 | B1 * | 5/2001 | Minners | 337/139 |
| 6,261,360 | B1 | 7/2001 | Dry | |
| 6,278,084 | B1 | 8/2001 | Maynard | |
| 6,310,411 | B1 | 10/2001 | Viallet | |
| 6,379,393 | B1 * | 4/2002 | Mavroidis et al. | 623/25 |
| 6,447,478 | B1 | 9/2002 | Maynard | |
| 6,483,058 | B2 | 11/2002 | Ehrensberger | |
| 6,705,813 | B2 | 3/2004 | Schwab | |
| 6,812,820 | B1 * | 11/2004 | Fouillet | 337/333 |
| 2001/0009982 | A1 | 7/2001 | Ferrera et al. | |
| 2002/0123750 | A1 | 9/2002 | Eisermann et al. | |
| 2003/0011450 | A1 | 1/2003 | Shen et al. | |
| 2003/0156006 | A1 | 8/2003 | Hanke et al. | |
| 2004/0080239 | A1 | 4/2004 | Gupta et al. | |
| 2004/0150491 | A1 | 8/2004 | Kondoh et al. | |

FOREIGN PATENT DOCUMENTS

| | | | |
|---|---|---|---|
| EP | 554128 | A1 | 8/1993 |
| EP | 1 143 466 | A | 10/2001 |
| EP | 1273808 | A1 | 1/2003 |
| GB | 213 602 | A | 8/1924 |
| JP | 01 147090 | A | 9/1989 |
| JP | 1241808 | A | 9/1989 |
| JP | 3193070 | A | 8/1991 |
| JP | 03 291821 | A | 3/1992 |
| JP | 5015601 | A | 1/1993 |
| JP | 7335039 | A | 12/1995 |
| JP | 2003255204 | A | 9/2003 |
| KR | 2003053238 | A | 6/2003 |
| WO | WO 9636462 | A1 | 11/1996 |
| WO | WO 98/29657 | | 7/1998 |
| WO | WO 02/075824 | A2 | 9/2002 |
| WO | WO 03/014789 | A3 | 2/2003 |

OTHER PUBLICATIONS

"SMA-thin film composites providing traveling waves," 771865 INSPEC (Abstract No. A2003-24-6860-003.).

Mi, Z., et al., "Technology of sensing and active intervention for robotic endoscope," Chinese Journal of Scientific Instrument vol. 22, No. 6 (pp. 606-609). 7186493 INSPEC (Abstract No. C2002-03-3390-059.).

Thakoor, S., et al., "The role of peizoceramic microactuation for advanced mobility," ISAF '96. Proceedings of the 10th IEEE Internat'l Symposium on Applications of Ferroelectrics Part vol. 1 (pp. 205-211). 5730606 INSPEC (Abstract No. B9712-2860-011; C9712-3260B-003.).

Guoping, Wang and Shahinpoor, M., "A new design for a bending muscle with an embedded SMA wire actuator," Proceedings of the SPIE—The Internat'l society for Optical Engineering Conference vol. 2715. 5382105 INSPEC (Abstract No. C9611-3260N-001.).

Hill, L., et al. "Shape memory alloy film for deployment and control of membrane apertures," Conference title: UV/Optical/IR Space Telescopes: Innovative Technologies and Concepts. 06822341. (Abstract).

Wei, ZG., et al., "Shape memory materials and hybrid composites for smart systems—Part II Shape-memory hybrid composites," Journal of Materials Science, 1998, v33, N15 (Aug. 1). 07315048 (Genuine Article #149DZ). (Abstract).

Sterzl, T., et al., "Bistable shape memory thin film actuators," Proceedings of the SPIE vol. 5053 (2002). 7771864 INSPEC (Abstract No. A2003-24-8185-017; B2003-12-0585-025.).

Winzek, B., et al., "Smart motion control by phase-coupled shape memory composites," 7510367 INSPEC (Abstract No. B2003-02-8380-009; C2003-02-3390C-191.).

Winzek, B., et al., "Bistable thin film composites with TiHfNi shape memory alloys," Conference: Transducers '01, Eurosensors XV, 11th Internat'l Conference on Solid-State Sensors and Actuators. Digest of Technical Papers. Part vol. 1 (2001). 7367415 INSPEC (Abstract No. B2002-10-0550-005.).

Galhotra, V., et al., "Shape memory alloy based microactuators," Conference: Actuator 2000. 7th Internat'l Conference on New Actuators and Internat'l Exhibition on Smart Actuators and Drive Systems. Conference Proceedings (2000) pp. 338-341. 7160549 INSPEC (Abstract No. B2002-02-2180B-008.).

Winzek, B., et al., "Recent developments in shape memory thin film technology," Materials Science and Engineering A v 378 n 1-2 Spec. Iss Jul. 25, 2004. (pp. 40-46). 06946013 E.I. No. EIP04298272208. (Abstract).

Taylor, P.M., et al., "The design and control of a tactile display based on shape memory alloys," IEEE Colloquium on Developments in Tactile Displays (Digest No. 1997/012) (pp. 1-4). 5534475 INSPEC (Abstract No. C9705-5540B-002.).

Taylor, P., "Tactile and kinaesthetic feedback in virtual environments," Transactions of the Institute of Measurement and Control vol. 17, No. 5, (pp. 225-233). 5247589 INSPEC (Abstract No. B9606-7230-006; C9606-3390-004.).

Johnson, A.D., "TiNi thin film actuated microrelays and microswitches," 00275820 Identifying No. 36150 Agency Code SBIR. (1997) (Abstract).

Johnson, A.D., "Microactuated Resettable Switch," 0273076 Identifying No. 32378 Agency Code SBIR. (1996) (Abstract).

Johnson, A.D., "Tactile feedback output device for scanning tunneling microscope," 00261123 Identifying No. 17435 Agency Code SBIR. (1992) (Abstract).

Johnson, A.D., "Shape memory alloy tactile feedback actuator," 00253535 Identifying No. 9218 Agency Code. (1988) (Abstract).

Tretiakoff, O., "SBIR Phase I: Tactile Graphic array," 0190998 Idenitfying No. 00339004 Agency Code: NSF. (Abstract).

Xiong K. and Shen W., "Experimental research on the relationship between SMA wire wound angle and SMA torsion actuator primary performance," Chinese Journal of Mechanical Engineering vol. 39, No. 12 Conference Title: Proceedings 11th Symposium on Haptic Interfaces for Virtual Environment and Teleoperastor Systems. 7972980 INSPEC (Abstract No. C2004-07-3260N-001.).

Mineta, T., et al., "An active guide wire with shape memory alloy bending actuator fabricated by room temperature process," 11th International Conference on Solid-State Sensors and Actuators. Digest of Technical Papers Part vol. 1 (2001). 7367413 INSPEC (Abstract No. C2002-10-3260N-002.).

Taylor, P.M., et al., "A sixty-four element tactile display using shape memory alloy wires," Displays vol. 13, No. 3 (May 15, 1998). 5989415 INSPEC (Abstract No. C9809-5540B-005.).

Fisher, H. et al., "Actuator Array for use in minimally invasive surgery," Journal de Physique IV (Colloque); Conference Title: J. Phys. IV, (Nov. 1997). 5930880 INSPEC (Abstract No. C9807-3385-004.).

Kaneko, S., et al., "Multi-freedom micro manipulator with SMA plate," Transactions of the institute of Electrical Engineers of Japan, Part E, vol. 116-E, No. 8 (Oct. 1996). 5522439 INSPEC (Abstract No. B9704-2575-016; C9704-3390M-068.).

Howe, R.D., et al., "Shape Memory Alloy actuator controller design for tactile displays," Proceedings of the 34th IEEE Conference on Decision and Control Part vol. 4 (1995), 5183654 INSPEC (Abstract No. C9603-3390T-011.).

Kontarinis, D.A., et al., "Static Display of Shape," Proceedings of the SPIE vol. 2351 (1994). 5147145 INSPEC (Abstract No. C9602-5540B-001.).

Yoichi, H., et al., "2D Pin Display for Blind Aid Using SMA Micro Actuator," Japan Society of Mechanical Engineers Symposium on Welfare Engineering, 2003 vol. 3rd, Fig. 4, Tbl. 1, Ref. 4. 05693692 JICST Accession No. 04A0066018. (Abstract).

Hasser, C., et al., "Preliminary evaluation of a shape-memory alloy tactile feedback display," Proceedings of the 1993 ASME Winter Annual Meeting; Advances in Robotics, Mechatronics and Haptic Interfaces American Society of Mechanical Engineers, Dynamic Systems and Control Division DSC v 49 (1993). 03802775 E.I. No. EIP94021215203. (Abstract).

Lagoudas, D.C., "Proceedings of SPIE—Smart Structures and Materials 2003: Active Materials. Behavior and Mechanics," *The international Society for Optical Engineering*, v. 5053, p. 639 (2003). E.I. No: EIP03487761189. (Abstract).

Shimoga, K.B., et al., "Touch and force reflection for telepresence surgery", Proceedings of the 16th Annual International Conference of the IEEE Engineering in Medicine and Biology Society. Engineering Part vol. 2, pp. 1049-1050 (1994). (Abstract No. A9523-8770G-021.).
"European Workshop on Smart Structures in Engineering and Technology," (2003). INSPEC (Abstract No. A2003-19-0130C-006, B2003-09-0100-050.).
"Semiactive control of a shape memory alloy hybrid composite rotating shaft," (2001). INSPEC (Abstract No. C2002-03-3330-001.).
"Micron sized arm using reversible TiNi alloy thin film actuators," (1992). INSPEC (Abstract No. A9321-0670-003, C9311-3260Z-002.).
"Utilizing adaptive wing technology in the control of a micro air vehicle," (2002). Conference Title: Smart Structures and Materials 2002: Industrial and Commercial Applications of Smart Structures Technologies. (Abstract).
"Active robotic endoscope for minimally invasive surgery," (2002). (Abstract).
Control of flow-induced vibrations using shape-memory alloy wires (1993). Conference Title: Proceedings of the 1993 ASME Winter Annual Meeting. (Abstract).
"Trial fabrication of micron sized arm using reversible TiNi alloy thin film actuators," (1993). Conference Title: Proceedings of the 1993 IEEE/RSJ International Conference on Intelligent Robots and Systems. (Abstract).
"Diagnosis of Urinary Disorders Using Ultra-Thin Ultrasound Probe," (2000). JICST Accession No. 01A0116364File Segment: JICST-E. (Abstract).
"Micron Sized Arm Using RSMA Thin Films," (1993). JICST Accession No. 93A0904972 File Segment: JICST-E. (Abstract).
"Robust Regulation and Trajectory Tracking for Flexible Robots by Using Piezoelectric Actuators," Genuine Article #: VF107. (Abstract).
"Geometrically Nonlinear Modeling of Contact Problems Involving Thin Elastic Layers," Genuine Article #: UV399. (Abstract).
"Vacuum-deposited TiNi shape memory film: characterization and applications in microdevices," (1991). INSPEC (Abstract No. A9201-6855-064, B9201-7230-035, C9201-3260B-007.).
"Optical processors for smart structures," (1990). INSPEC (Abstract No. B91017651, C91022500.).
"Novel Sensor Technology for Shear and Normal Strain Detection with Generalized Electrostriction," (2000). Conference Title: First IEEE International Conference on Sensors—IEEE Sensors 2002. (Abstract).
"Fabrication and investigation of in-plane compliant SU8 structures for MEMS and their application to micro valves and micro grippers," (2000). INSPEC (Abstract Number: B2002-10-8380M-006, C2002-10-3260P-006.).
"Environmental recognition devices," (2000). INSPEC (Abstract Number: B202-08-2575F-097, C2002-08-3355F-014.).
"Fiberscope-type environmental recognition devices," (1999). INSPEC (Abstract Number: B2000-05-0170L-014, C2000-05-3355F-009.).
"Development of a microfine active bending catheter equipped with MIF tactile sensors," (1999). INSPEC (Abstract Number: B1999-11-7520-009, C1999-11-3385-021.).
"SBIR Phase I: Tactile Graphic Array," Identifying No. 0339004 Agency Code: NSF. (Abstract).
"Shape Memory Materials: Constitutive Modeling and Finite Element Analysis (Elasticity, Smart Materials, Strain)," (1997). Order No. AAD98-26978. (Abstract).
"Development of a shape memory alloy actuator for an intelligent eye prosthesis," (2002). Order No. AADAA-IMQ81375. (Abstract).
"Modeling of shape memory alloys with plasticity," (2001). Order No. AADAA-I3018481. (Abstract).
"Large Deformation Analysis of Flexible Rods (Elastic)," (1996). Order No. AADNN-18096. (Abstract).
"Design and Fabrication of Multiplexed Two-Dimensional Transducer Arrays Using Electrostrictive Ceramic Materials (Beam Width, Volumetric Scanner, Ferroelectric)," (1997). Order No. AAD98-07805. (Abstract).
"Sensory perception," (haptics). (2003). Supplier No. 102903850. (Abstract).
"Twenty-One Real-Time Interactive Installations in SIGGRAPH 2003 Emerging Technologies Program," (2003). Supplier No. 102345123. (Abstract).
"It Just Feels Right." (new 'heptic' I/O technologies) (Technology Information) (1998). Supplier No. 53113482. (Abstract).
"Micromachining moves into high gear," (1990). Supplier No. 08920530. (Abstract).
"Nanoscale memory technology could squeeze 12Tbytes onto CD-size space," (2004). Supplier No. 119253737. (Abstract).
"The New Standard,"(2000). Supplier No. 59450399. (Abstract).
"Stented graft for delivering medicinal agents, comprises stent and flexible, porous, biocompatible tubular elastomeric covering and is coated with polymer and therapeutic substance," WPI Acc No. 2002-589126/200263. (Abstract).
"Stented graft for cardiovascular treatment, has polytetrafluoroethylene tubular covering which is deployed with several stents existing in compact and expandable configurations alternatively," WPI Acc No. 2002-361049/200239. (Abstract).
"Producing fibre reinforced plastic—by spirally *winding* *shape* *memory* *alloy* rod with FRP *tape*, wrapping in heat insulating film, inserting in outer mould, heating, etc.," WPI Acc No. 1991-211082/199129. (Abstract).
"Method for forming *nickel*-*titanium* braided arch wires—involves deforming braid before *windings* it about fixture for heat treatment and *cutting*," WPI Acc No. 1992-048133/199206. (Abstract).
"Loop-shaped alloy suture with needle end—is temp. difference recoverable from deformed state to draw wound edges together," WPI Acc No. 1991-109289/199115. (Abstract).
"Cryotherapy system for e.g. treating mammalian injuries has heat exchanger for volatilizing refrigerant, sensor for sensing physiological property of mammal, and control that alters refrigerant flow rate based on sensor output," WPI Acc No. 2002-105582/200214. (Abstract).
"Electronic device connector—has terminal consisting of at least two sheets of shape memory alloy showing psuedo-elastic behaviour with adjacent ends slidable against pin," WPI Acc No. 1984-241610/198439. (Abstract).
"Patch system useful for transdermal delivery of a drug by forming a micropore in a tissue membrane of an animal, comprises an actuator, a porator array, and a reservoir patch attached to the extension tab," WPI Acc No. 2003-865030/200380. (Abstract).
"Stented graft useful as implants for treating cardiovascular disorders comprises stent coated with coat comprising composite of polymer and therapeutic substance, and tubular elastomer covering," WPI Acc No. 2003-558843/200352. (Abstract).
"Actuator for use in high speed safety system for power tool such as table saws, uses solenoid or shape memory alloy wire that causes leaf spring to move into contact with blade," WPI Acc No. 2003-312248/200330. (Abstract).
"Ball grid *array* type semiconductor device mounted on circuit board, has several electrodes in semiconductor element, to which bump of *shape* *memory* *alloy* is connected by heating," WPI Acc No. 2002-744146/200281. (Abstract).
"Semiconductor package e.g. ball-grip array type semiconductor package, has rod-shaped support pillars that extends from lower surface to package at temperature more than transformation point of shape memory alloy," WPI Acc No. 2000-427610/200037. (Abstract).
"Clamping mechanism using shape memory alloy springs to separate pad-on-pad connectors—has bow shaped pieces of shape memory alloy with keyhold-shaped cut-outs, bow held i metal cage, and applies tensile force to through-carrier pins mounted on elastomer-faced backplate," VPI Acc No. 1993-107384/199313. (Abstract).
"Connector of electrode array—uses shape memory alloy to contact connector and fixed wall by expanded shape," WPI Acc No. 1989-342820/198947. (Abstract).
"Temp. sensitive oil flow control valve in shock absorber piston—modifies flow through holes in piston as change in temp. raises or lowers petals of flower shape spring made of shape memory alloy," WPI Acc No. 1989-070773/198910. (Abstract).

Self tracking mechanism for solar collector—employs an array of sensor reflectors generating alignment forces in shape memory alloy elements, WPI Acc No. 1984-172352/198428. (Abstract).

"Memory-Metal Actuators for Automotive Applications," IEEE, 1995, INSPEC (Abstract No. C9502-3260Z-001).

"Actuator for Out-of-Plane MEMS Devices," 00265601 Identifying No. 32021, Agency Code: SBIR. (Abstract).

Hugel, J., "Automatic Testing of Internal Combustion Engines in Production Lines," *Werkstatt und Betrieb*, 108(3), pp. 153-155, Mar. 1975. (Abstract).

Taylor, P.M., et al., "The Design and Control of a Tactile Display Based on Shape Memory Alloys," *IEEE*, 2, pp. 1318-1323, 1997. (Abstract).

* cited by examiner

800

1. Screen print or stencil adhesive.

2. Remove screen

3. Position carriage tape alignment frame loaded with SMA tapes

4. Embed SMA into adhesive

THIN, FLEXIBLE ACTUATOR ARRAY TO PRODUCE COMPLEX SHAPES AND FORCE DISTRIBUTIONS

GOVERNMENT SUPPORT

The invention was made with government support awarded by the U.S. Navy under Grant Number N66001-02-C-8022. The Government has certain rights in the invention.

BACKGROUND OF THE INVENTION

Restoring mechanisms, also known as "overcenter mechanisms," "snap springs," "snap blades," and the like, are components of many devices, including valves and electrical switches.

Monostable mechanisms are known. For example, a rigid support can be overlaid by a membrane with projections that restore push buttons, such as those of a telephone keypad, back to an undepressed position. However, such designs lack a second stable position as in a bistable mechanism.

Discontinuous cantilever bistable mechanisms are known, wherein discontinuous cantilevered tongues are held in relation to each other by a surround fashioned from the same sheet as the cantilevers. These discontinuous cantilevers can impart bistable movement to a notched rod captured between the tips of the cantilevers. Discontinuous cantilevers can be undesirable, however, for applications needing a smooth surface on the bistable mechanism.

Dome-like bistable mechanisms, including linear and planar arrays thereof, have been fabricated of thin sheet metal. However, common materials typically limit the height of the dome to about 10% of its diameter, and consequently the maximum throw can be limited to about twice the dome height (hence, about 20% of a diameter).

Disk-like bistable mechanisms are known where a disk is buckled by insertion into a circular housing slightly smaller than the disk. Alternately, or in conjunction, disk mechanisms can be buckled by introduction of a part, such as a rod, that radially displaces portions of the mechanism. These designs can require assembly and one or more additional parts for proper function, and can have limitations similar to dome-like mechanisms.

A micromechanical continuous buckled beam mechanism includes a bistable bridge spanning a recess in an underlying support material. Such a design includes at least two parts (the bridge and the rigid support which must be assembled). Moreover, the rigid support can be unsuitable for applications requiring flexibility and/or for macroscopic applications where the added weight of the rigid support is undesirable.

Piezoelectric actuators are known, but can be expensive and bulky, and can require complicated control electronics. Shape memory alloy actuators are known, but can involve significant amounts of heat generation and can have high power requirements, and can be limited in frequency. For example, maintaining a stable position with existing shape memory actuators can require continuous input of power, which can be undesirable for portable applications and can generate undesirable amounts of heat. Moreover, the operation frequency of shape memory actuators can be limited by heat dissipation because the alloy needs to cool below its activation temperature before the actuator can be operated again.

SUMMARY OF THE INVENTION

There is therefore a need in the art for improved bistable mechanisms suitable for actuators, arrays of such actuators, means of operating or controlling actuators, and methods of manufacturing actuators.

An actuator includes a bistable mechanism having a tension beam and a compression beam defined by a relief slit in a flexible substrate; and a first shape memory element that upon heating actuates the bistable mechanism from a first position to a second position. In various embodiments, the tension beam and the compression beam can be substantially parallel. The tension beam can include a permanent out-of-plane deformation. The actuator can include a second tension beam defined by a second relief slit. The first shape memory element can include a shape memory alloy, a bimetallic strip, or a thermally-actuated shape memory polymer. The actuator can include a second shape memory element that actuates the bistable mechanism from the second position to the first position. A heat source can be thermally coupled to each shape memory element that independently heats the shape memory elements to actuate the bistable mechanism. Or, the actuator can include electrical leads coupled to each shape memory element that independently heat the shape memory elements to actuate the bistable mechanism. The first shape memory element can include at least two substantially parallel shape memory alloy wires electrically coupled in series to the electrical leads. The shape memory elements can be mechanically coupled to opposite sides of the compression beam to convert the displacement of each shape memory element into a greater displacement at the compression beam. The flexible substrate can include a material selected from the group consisting of steel alloy, phosphor bronze alloy, aluminum alloy, titanium alloy, carbon fiber/epoxy composite, fiberglass/epoxy composite, Kevlar/epoxy composite, polyimide, polyamide, polyester, polyvinylidene fluoride (PVDF), polypropylene, polyethylene, and urethane. The shape memory element can be in the form of a laminated array of shape memory wires mechanically coupled to the bistable mechanism. A first heat source can be thermally coupled to the first shape memory element. A second heat source can be thermally coupled to the second shape memory element. The shape memory wires can be substantially physically parallel shape memory alloy wires. The wires can include a shape memory alloy selected from the group consisting of NiTi, CuZnAl, and CuAlNi. Preferably, the wires are NiTi. The shape memory wires can have a diameter of less than about 500 micrometers. The ratio of the diameter of the wires divided by the distance between adjacent wires can be less than about 1. The actuator operates in air at 25° C. at a frequency of at least about 2 cycles per second. The actuator can be adapted for automatic control. For example, the shape memory element can be coupled to an open loop automated controller.

In some embodiments, an actuator includes a bistable mechanism and a first shape memory element mechanically coupled to the bistable mechanism that upon heating exerts a force that actuates the bistable mechanism from a first position to a second position; in such embodiments, the first shape memory element includes a laminated array of shape memory wires. In various embodiments, a first heat source can be thermally coupled to the first shape memory element, or electrical leads can be coupled to the first shape memory element, whereby the first shape memory element is heated by application of electrical current. The first shape memory element can include at least two substantially parallel shape memory alloy wires electrically coupled in series to the electrical leads. A second heat source can be thermally coupled to a second shape memory element at the bistable mechanism that heats the second shape memory element to exert a force that actuates the bistable mechanism from the second position to the first position. The shape memory wires can be substantially physically parallel shape memory alloy wires. The wires can include a shape memory alloy selected from the group consisting of NiTi, CuZnAl, and CuAlNi, in some embodiments NiTi. The shape memory wires can have a diameter of less than about 500 micrometers. The ratio of the diameter of the wires divided by the distance between adjacent wires can be less than about 1. The actuator can operate in air at 25° C. at a frequency of at least about 2 cycles per second. The bistable mechanism can include a tension beam and a compression beam defined by a relief slit in a flexible substrate, and the first shape memory element can actuate the compression beam from the first position to the second position. The tension beam can include a permanent out-of-plane deformation. Each shape memory element can be coupled to the compression beam to convert the displacement of each shape memory element into a greater displacement at the compression beam. A second tension beam defined by a second relief slit can be included, wherein the beams and the slits can be substantially parallel. The actuator adapted for automatic control, e.g., by coupling to an open loop automated controller. The flexible substrate can include a material selected from the group consisting of steel alloy, phosphor bronze alloy, aluminum alloy, titanium alloy, carbon fiber/epoxy composite, fiberglass/epoxy composite, Kevlar/epoxy composite, polyimide, polyamide, polyester, polyvinylidene fluoride, polypropylene, polyethylene, and urethane.

An actuator array includes two or more of any of the above actuators in the flexible substrate. The flexible substrate can be in the form of a tape including the array of actuators as a linear array; or, the flexible substrate can be in the form of a sheet including the array of actuators as a two-dimensional array. The array can include one or more multiplexing diodes to independently control each actuator. The array can include an open loop automated controller coupled to the actuators.

A method of operating the actuator includes automatically controlling the actuator by heating the first shape memory element to exert a force that actuates the bistable mechanism from a first position to a second position. A second heat source can be heated to actuate a second shape memory element to exert a force that actuates the bistable mechanism from the second position to the first position. In various embodiments, the shape memory elements can be at ambient temperature while the bistable mechanism maintains the first position or the second position, e.g., the heat sources can be deactivated after actuating the actuator.

A method of operating the actuator array includes automatically, independently controlling each actuator.

A method of manufacturing a shape memory element includes wrapping a shape memory wire and an adhesive substrate on a spool to create a layer of substantially physically parallel wire loops adhered to the adhesive layer, and separating a discrete shape memory wire element, the element including an array of substantially physically parallel shape memory wire segments adhered to a discrete portion of the adhesive substrate. The adhesive substrate can include a pattern that defines each discrete shape memory element. The method can include separating each discrete shape memory wire element by mechanical cutting, or by laser cutting. The method can include wrapping the adhesive substrate on the spool and wrapping the wire on the adhesive substrate to contact the wire to the adhesive layer; or, the method can include wrapping the wire on the spool, and wrapping the adhesive substrate on the wire to contact the adhesive layer to the wire. The method can include curing the adhesive layer of the adhesive substrate to create a laminated shape memory element. The wire segments of each discrete shape memory wire element can be cured in a curable matrix to create the laminated shape memory element. The method can include stenciling a conducting adhesive between at least two of the wire segments, whereby the wire segments are conductively linked.

The disclosed inventions have numerous advantages over the prior art. For example, the method of manufacturing the shape memory elements from wire is less expensive than other methods such as sputtering and etching, and creates fewer environmental hazards. Mechanically cutting the wires allows the elements to function without re-annealing, which also allows the use of substrates such as non-polyamide polymers, with melting temperatures below the annealing temperature of shape memory alloys.

Moreover, the separate wires can have more surface area which can allow better contact with laminating adhesive to avoid wire pull-out, and can dissipate heat more rapidly compared to larger pieces of shape memory alloy. High surface area per unit volume can allow a higher actuation frequency.

Also, the shape memory elements in the disclosed inventions are discrete. Compared to devices wherein adjacent actuators are formed from a continuous piece of shape memory alloy, the disclosed inventions can be more isolated and thus can experience less thermal cross talk.

Moreover, coupling two shape memory elements with a bistable mechanism allows the actuator to maintain a position while shut off after actuation, which can minimize power consumption and heat production compared to existing devices. This can be particularly beneficial for devices intended to operate in power or temperature sensitive environments, such as handheld massagers, massage chairs, massaging foot spas, massaging car seat covers, and similar products intended to operate near the human body.

Also, the elastic energy stored in the bistable mechanism can provide a restoring force to return a shape memory element to its original length after contraction.

Further, the bistable mechanism can transform the short (4%) contraction typical of shape memory alloys into a displacement large enough to be useful, when shape memory elements are coupled to the compression beam of the bistable mechanism; or can transform the contraction into a shorter but more forceful motion when the shape memory elements are coupled to the tension beam.

Another benefit of the bistable mechanism is that it enables simple, robust, open-loop control, whereas other devices can require complex closed-loop control because the resistance and Young's modulus of shape memory alloys change nonlinearly with heating, and the work cycle has hysteresis.

Yet another benefit of the bistable mechanism is that mechanisms of different orientations, size, mechanical characteristics, spacing, and the like can be combined in the same array of actuators.

DETAILED DESCRIPTION OF THE INVENTION

Figure 1A:
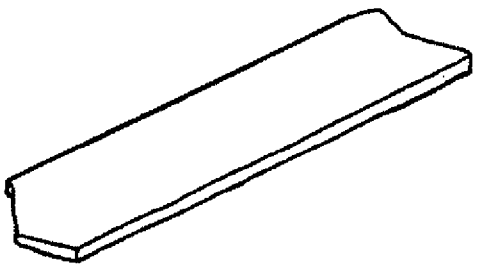
FIGS. 1A, B and C are drawings showing A) a flexible substrate 102; B) a relief slit 104 formed in flexible substrate 102 and C) an exploded view of an actuator 100 wherein relief slit 104 defines a tension beam 106 and a compression beam 108, and the compression beam can be deformed to a first stable position. Also included in C) is a shape memory element 110.

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention. A description of preferred embodiments of the invention follows.

Figure 1B:
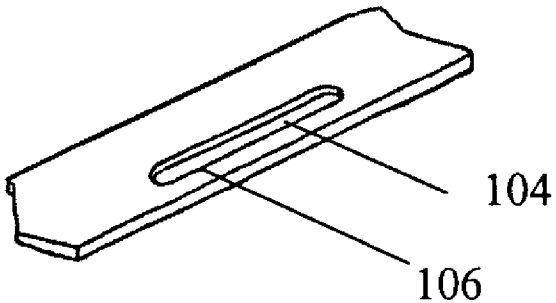
FIGS. 1D, E and F are a sequence of drawings showing D) with actuator 100 in a first position, beginning actuation of shape memory element 110; E) a representation of actuator 100 between the first position and a second position; F) actuator 100 in the second position.
FIG. 1G depicts shape memory element 110' that includes a set of at least two substantially physically parallel shape memory alloy wires 12'.
FIG. 1H depicts shape memory element 110' wherein wires 12' can be coupled electrically in parallel with respect to the current that can be employed for resistive heating via conducting links 14'.
FIG. 1I depicts an embodiment of a shape memory element 110" where two wires 12"*a* and 12"*b* can be electrically coupled in series via conducting link 14", which can increase the electrical resistance of shape memory element 110" to facilitate such resistive heating.
FIG. 1J depicts an embodiment of a shape memory element 110'" wherein at least two groups 10'" (e.g., four) of two or more (e.g., three) parallel shape memory alloy (e.g., Nitinol) wires 12'", wherein adjacent groups 10'" can be electrically coupled via coupling links 14'"*a*-14'"*e*.
FIG. 1K depicts an intermediate step in some embodiments of manufacturing the shape memory element 110'" shown in FIG. 1J.
Figure 1C:
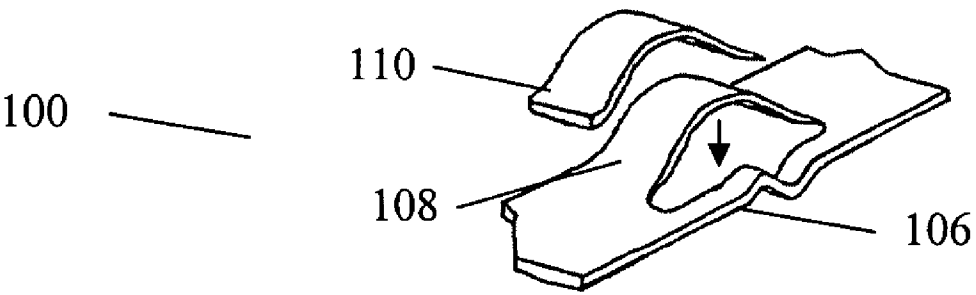

FIGS. 1A, 1B, 1C and 1C are drawings showing (FIG. 1A) a flexible substrate 102; (FIG. 1B) a relief slit 104 formed in flexible substrate 102 and (FIG. 1C) an exploded view of an actuator 100 wherein relief slit 104 defines a tension beam 106 and a compression beam 108, and the compression beam can be deformed to a first stable position. Also included in FIG. 1C) is a shape memory element 110. Tension beam 106 and compression beam 108 can be formed to be substantially parallel, e.g., parallel in the plane of flexible substrate 102. Compression beam 108 can be formed into a first position as shown in mechanism 100. For example, a stable deformation of compression beam 108 out of the plane of flexible substrate 102 can be made. A sufficient force having a component in the direction of the arrow can actuate compression beam 106 from the first position in 100 to a second position, e.g., a complementary out of plane deformation on the opposite side of flexible substrate 102 in the direction shown by the arrow.

Figure 1D:
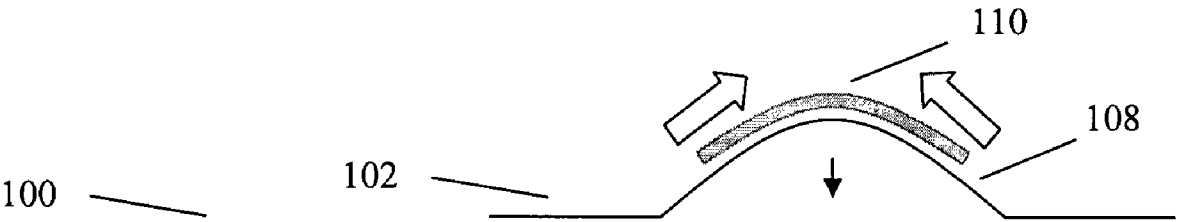
Figure 1E:
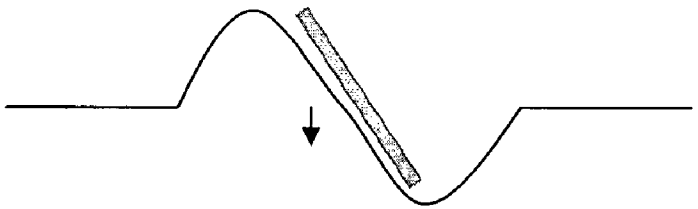
Figure 1F:
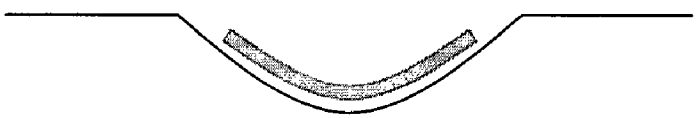

FIGS. 1D, E and F are a sequence of drawings showing D) with actuator 100 in a first position, beginning actuation of shape memory element 110; E) a representation of actuator 100 between the first position and a second position; F) actuator 100 in the second position. In these views, relief slit 104 is not seen and tension beam 106 is omitted for clarity. In FIG. 1D, compression beam 108 starts at a first stable position. Actuation begins when shape memory element 110 is activated and shortens in the direction shown by the pair of large arrows. This stresses compression beam 108, causing it to move through the plane of substrate 102 as shown in FIG. 1E, until actuator 100 comes to rest at a second stable position in FIG. 1F. An actuator such as 100, with only a single shape memory element, can be useful for applications where an external force can operate the actuator from the second position to the first position, e.g., by a human operator pushing the actuator from the second position to the first position.

Flexible substrate 102 can include a material selected from the group consisting of steel alloy, phosphor bronze alloy, aluminum alloy, titanium alloy, carbon fiber/epoxy composite, fiberglass/epoxy composite, Kevlar/epoxy composite, polyimide, polyamide, polyester, polyvinylidene fluoride (PVDF), polypropylene, polyethylene, polyurethane, and the like.

Bistable actuator 100 includes a separate shape memory element 110, which can be made of a shape memory alloy, a bimetallic strip, thermally-actuated shape memory polymers (such as styrene-based thermally-actuated shape memory polymers and oligo(e-caprolactone) dimethacrylate+n-butyl acrylate thermally-actuated shape memory polymers), or the like.

Typically, shape memory element 110, can be made of a shape memory alloy. As used herein, shape memory alloy can include any such alloy know to the art, for example, NiTi, CuZnAl, CuAlNi, and the like. More preferably, shape memory element 110 is NiTi.

As used herein, a bimetallic strip can be any combination of two metals that expand differently in response to increasing temperature. Such strips are well-known to the art, for example, bimetallic strips employed in thermostats, and the like. Shape memory element 110 can be a bimetallic strip separate from flexible substrate 102. Or, flexible substrate 102 can function as one metal of the bimetallic strip. In embodiments wherein two shape memory elements, as bimetallic strips, are employed on opposing sides of the bistable mechanism, flexible substrate 102 can function as one metal of each bimetallic strip.

Shape memory element 110 can be actuated by heating, e.g., by resistive heating through a current passed through the element, by application of a voltage, by thermal contact with a separate heating element, by radiative or convective heat transfer from an external heat source, or the like. Typically, shape memory element 110 is actuated by heating with a resistive heating element that is in thermal contact with the shape memory element.

Figure 5B:
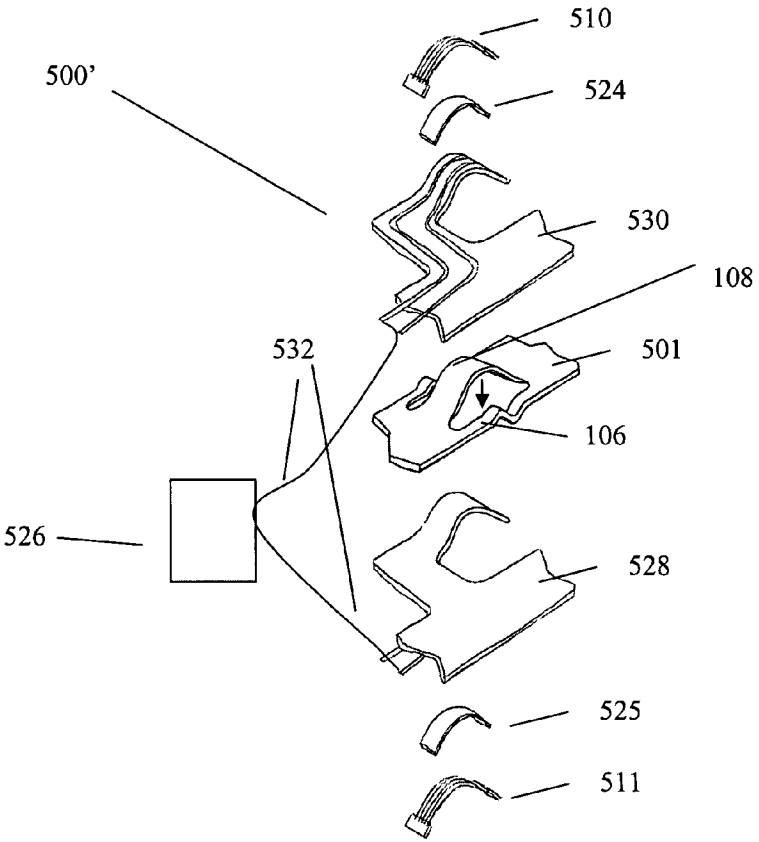
FIG. 5B is a drawing showing an exploded view of actuator 500 further including bistable mechanism 501 equipped to be actuated by first shape memory element 510 and also includes a second shape memory element 511 that actuates the bistable mechanism from the second position to the first position in a direction opposite the arrow.
Figure 5A:
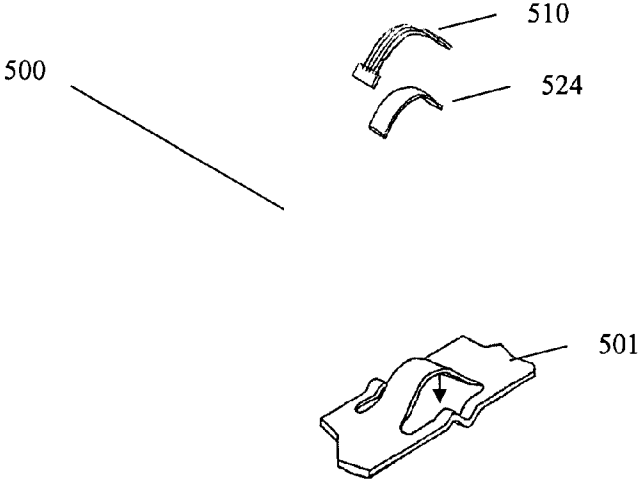
FIG. 5A is a drawing showing an exploded view of an actuator 500, which includes a bistable mechanism 501, a first shape memory element 510 mechanically coupled to the bistable mechanism, and a first heat source 524 thermally coupled to the first shape memory element that heats first shape memory element 510 to exert a force that actuates bistable mechanism 501 from a first position to a second position in the direction of the arrow.
Figure 9:
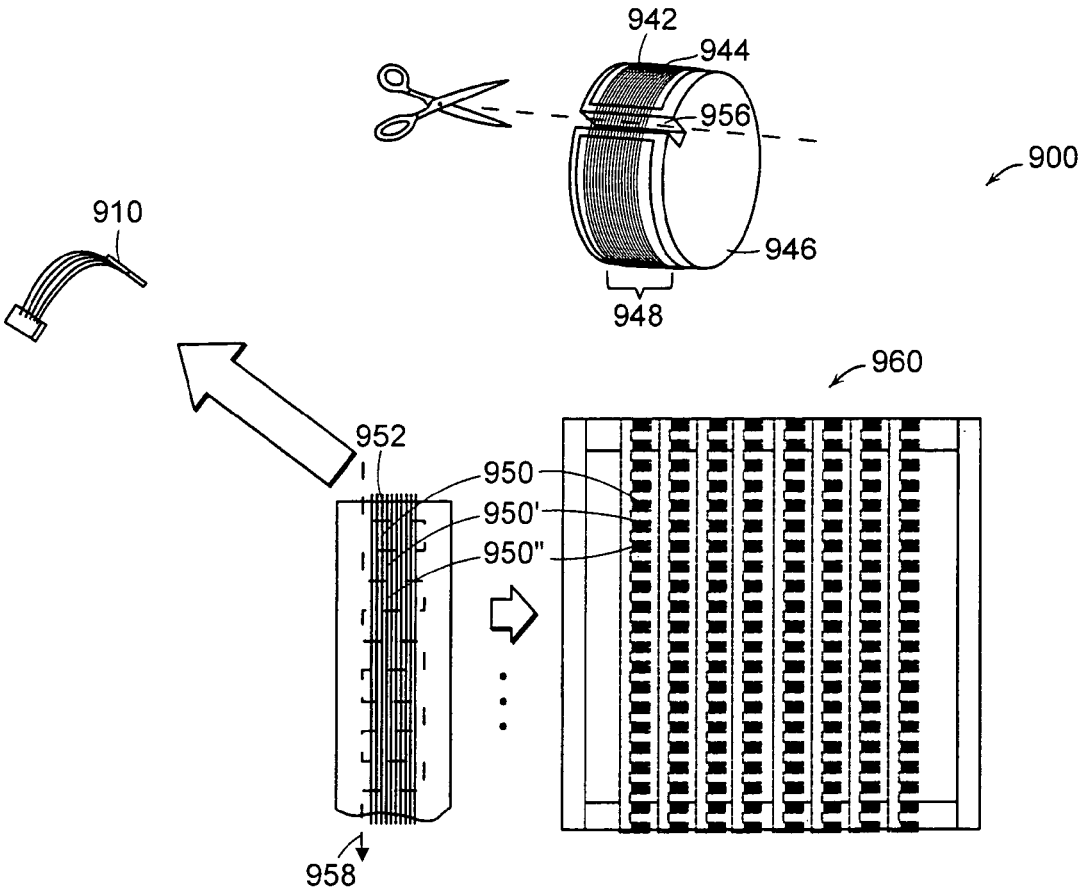
FIG. 9 is a drawing of a method of manufacturing a shape memory element.

Shape memory element 110 can be in the form of a strip or sheet, or more preferably is in the form of a set of substantially physically parallel shape memory alloy wires, typically in a laminated array; see also features 510/511 in FIG. 5A and 5B and feature 910 in FIG. 9. The wires can have a diameter of less than about 500 micrometers. The ratio of the diameter of the wires divided by the distance between adjacent wires can be less than about 1.

Figures 1G, 1H, 1I:
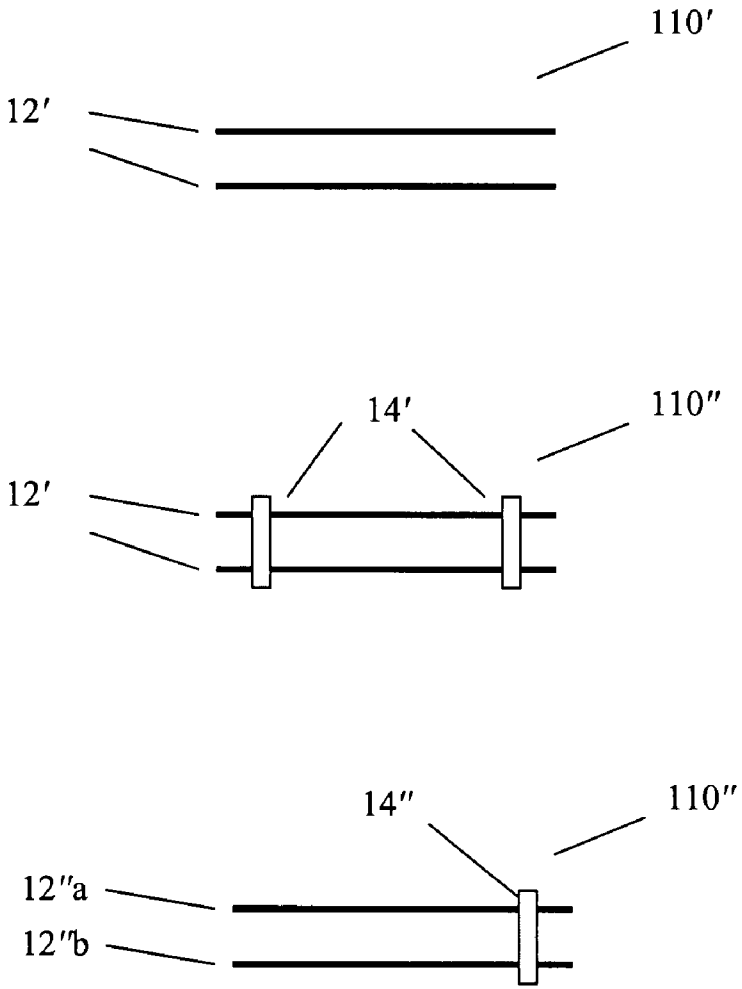

In various embodiments, the shape memory element can be actuated by resistive heating through a current passed through the element, wherein typically, the element is in the form of a set of at least two substantially physically parallel shape memory alloy wires 12' as shown in shape memory element 110' in FIG. 1G. 1*n* some embodiments, wires 12' can be coupled electrically in parallel with respect to the current that can be employed for resistive heating, e.g., via conducting links 14' as shown in FIG. 1H. Conducting links 14' can be a metallic conductor (e.g., a copper element that contacts each wire, metallic solder melted to each wire, and the like) or typically, a conductive epoxy or adhesive such as silver doped silicone adhesive, and the like.

FIG. 1I depicts an embodiment of a shape memory element 110" where two wires 12"*a* and 12"*b* can be electrically coupled in series via conducting link 14", which can increase the electrical resistance of shape memory element 110" to facilitate such resistive heating. For example, the current can be passed into one wire 12"*a,* through conducting link 14", and back through wire 12"*b.*

Figure 1J:
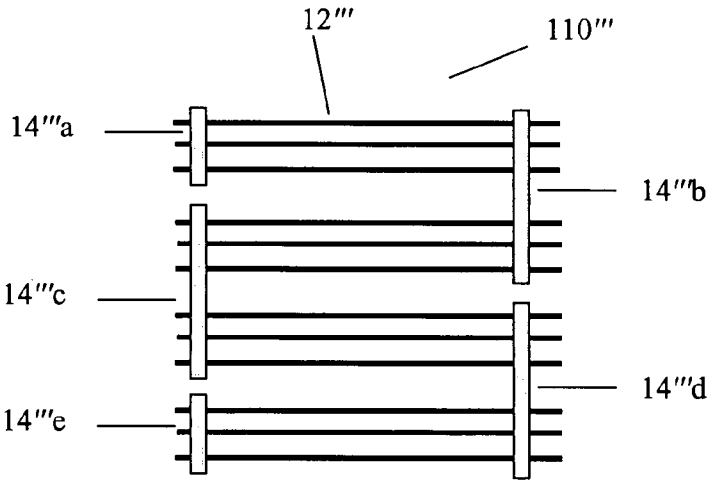

FIG. 1J depicts an embodiment of a shape memory element 110''' wherein at least two groups 10''' (e.g., four) of two or more (e.g., three) parallel shape memory alloy (e.g., Nitinol) wires 12''', wherein adjacent groups 10''' can be electrically coupled via coupling links 14'''*a*-14'''*e*. For example, current can be passed into shape memory element 110''' at coupling links 14'''*a* and pass in sequence through coupling links 14'''*b,* 14'''*c,* 14'''*d,* and 14'''*e.*

Figure 1K:
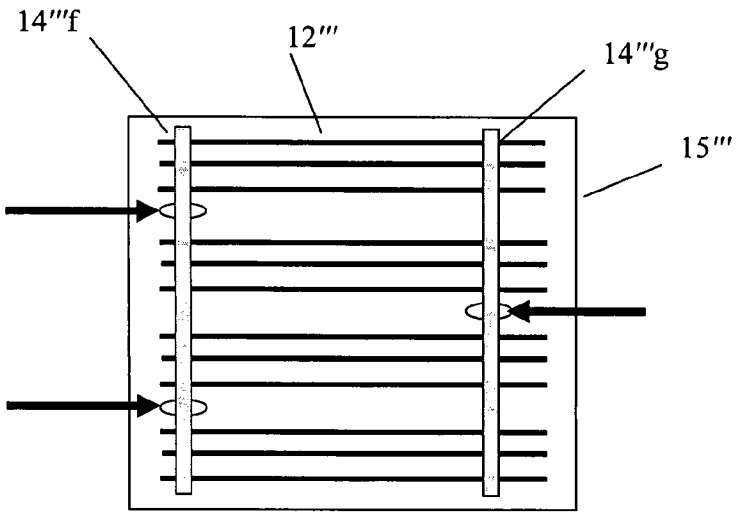

FIG. 1K depicts an intermediate step in some embodiments of manufacturing the shape memory element 110''' shown in FIG. 1J. The wires 12''' can be contacted to a substrate, e.g., adhesive substrate 15''' which can have holes at the positions indicated by the arrows. Coupling link material, e.g., a silver doped silicone adhesive can be stenciled in two sections 14'''*f* and 14'''*g*. After stenciling the silver conducting adhesive, adhesive substrate 15''' which has wires 12''' and stenciled silver doped silicone adhesive sections 14'''*f* and 14'''*g* on it, and the holes in adhesive substrate 15''' allow the excess silver doped silicone adhesive to fall through creating coupling links 14'''*a*-14'''*e* shown in FIG. 1J.

The frequency of operation of shape memory devices such as shape memory element 110 can be determined in part by the ability of the device to dissipate heat. For example, shape memory element 110 must be below its critical temperature before it can be actuated again. Thus, when shape memory element 110 is in the form a set of substantially physically parallel shape memory alloy wires, the extra surface area of the wires and the distance between adjacent wires can allow it to dissipate heat more rapidly than if shape memory element 110 was the same mass of shape memory alloy in a monolithic form such as a strip or sheet. Thus, in preferred embodiments, shape memory element 110 can be actuated at a frequency at 25° C. in air of at least about 2 cycles per second.

Figure 2:
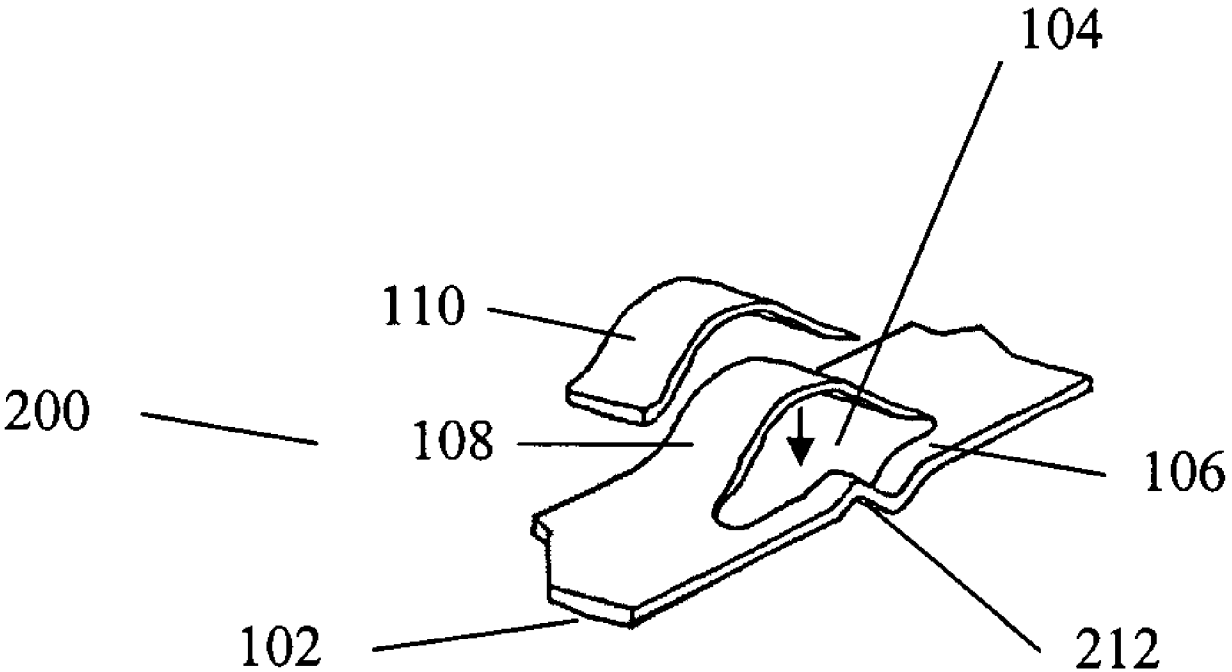
FIG. 2 is a drawing showing an exploded view of actuator 200, wherein the tension beam 106 can have a permanent out of plane deformation 212.

FIG. 2 is a drawing showing an exploded view of an actuator 200, wherein the tension beam 106 can have a permanent out of plane deformation 212. Deformation 212 can introduce greater tension into tension beam 106, which can lead to greater compression in compression beam 108. This can lead to a greater force required to actuate mechanism 200 (compared to mechanism 100), and/or to a greater force applied by mechanism 200 (compared to mechanism 100) as the mechanism moves from a first position to a second position in the direction of the arrow.

Figure 3:
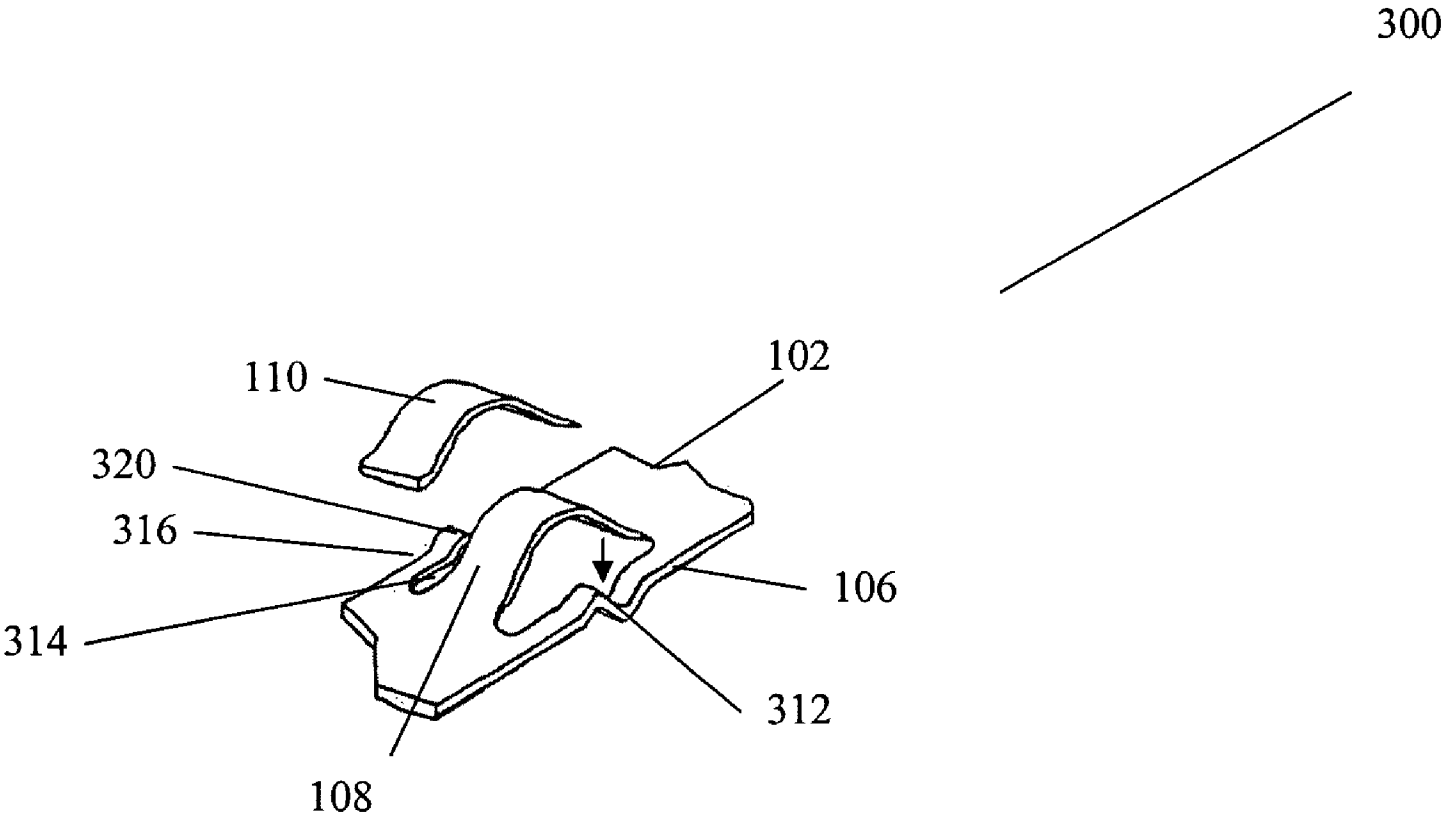
FIG. 3 is a drawing showing an exploded view of actuator 300 that includes a second relief slit 314 which defines a second tension beam 316 from compression beam 108.

FIG. 3 is a drawing showing an exploded view of an actuator 300 that includes a second relief slit 314 which defines a second tension beam 316 from compression beam 108. Tension beam 316 and compression beam 108 can be formed to be substantially parallel, e.g., parallel in the plane of flexible substrate 102. Tension beam 316 can have a permanent out of plane deformation 320.

Figure 4:
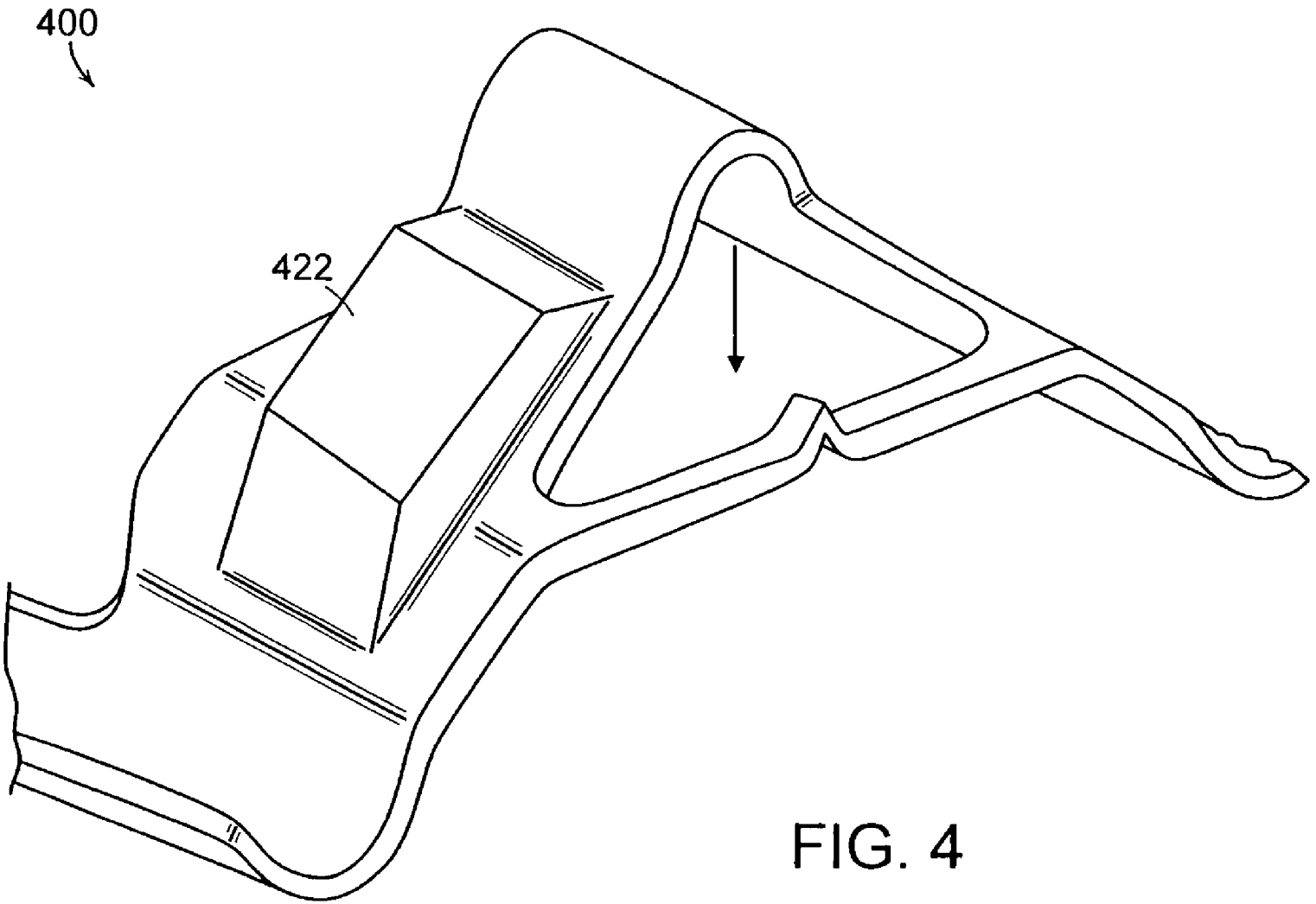
FIG. 4 is a drawing of a bistable mechanism 400 that includes a permanent out of plane deformation 422 in compression beam 408.

FIG. 4 is a drawing of a bistable mechanism 400 that includes a permanent out of plane deformation 422 in compression beam 408. For clarity, shape memory element (such as 110) is not shown. Deformation 422 can stiffen mechanism 400, which can lead to a greater force required to actuate mechanism 400 (compared to mechanism 100), and/or to a greater force applied by mechanism 400 (compared to mechanism 100) as the mechanism moves from its first position to its second position in the direction of the arrow. Deformation can also produce a relatively inflexible landing suitable for surface mount electronics or other components.

FIG. 5A is a drawing showing an exploded view of an actuator 500, which includes a bistable mechanism 501, a first shape memory element 510 mechanically coupled to the bistable mechanism, and a first heat source 524 thermally coupled to the first shape memory element that heats first shape memory element 510 to exert a force that actuates bistable mechanism 501 from a first position to a second position in the direction of the arrow. In embodiments of the actuator, shape memory element 510 can be any of the elements described above for the bistable mechanism in FIG. 1. Typically, in embodiments of the actuator, shape memory element 510 is a laminated array of shape memory wires as depicted.

FIG. 5B is a drawing showing an exploded view of actuator 500 further including bistable mechanism 501 equipped to be actuated by first shape memory element 510 and also including a second shape memory element 511 that actuates the bistable mechanism from the second position to the first position in a direction opposite the arrow. First and second heat sources 524 and 525 (e.g., resistive heating elements) can be thermally coupled to their corresponding shape memory element.

Shape memory elements 510 and 511 can be mechanically coupled to opposite sides of compression beam 108 to convert the displacement of each shape memory element into a greater displacement at the compression beam.

The actuator can be adapted for automatic control. For example, the shape memory element can be coupled to an open loop automated controller 526. Dielectric layers 528 and 530 can be included that can separate heat sources 524 and 525 from flexible substrate 102, e.g., when flexible substrate 102 is a conductor. Electrical leads 532 can be included to power heat sources 524 and 525. Leads 532 can be coupled to. automated controller 526.

Actuator 500 can be automatically controlled by operating controller 526 (e.g., an open loop automated controller) to heat first shape memory element 510 via heat source 524 to exert a force that actuates the bistable mechanism from a first position to a second position. The second shape memory element can be heated via heat source 525 to exert a force that actuates the bistable mechanism from the second position to the first position. Heat sources 524 and 525 can be deactivated after actuating the mechanism between the first and second positions after actuation, e.g., the shape memory elements can be at ambient temperature while the bistable mechanism maintains the first position or the second position. Controller 526 can be employed to control the displacement of shape memory elements 510 or 511 to give a greater displacement at compression beam 108, wherein shape memory elements 510 or 511 are mechanically coupled to compression beam 108. Controller 526 can be employed to operate the actuator at a frequency at 25° C. in air of at least about 2 cycles per second.

Figure 6B:
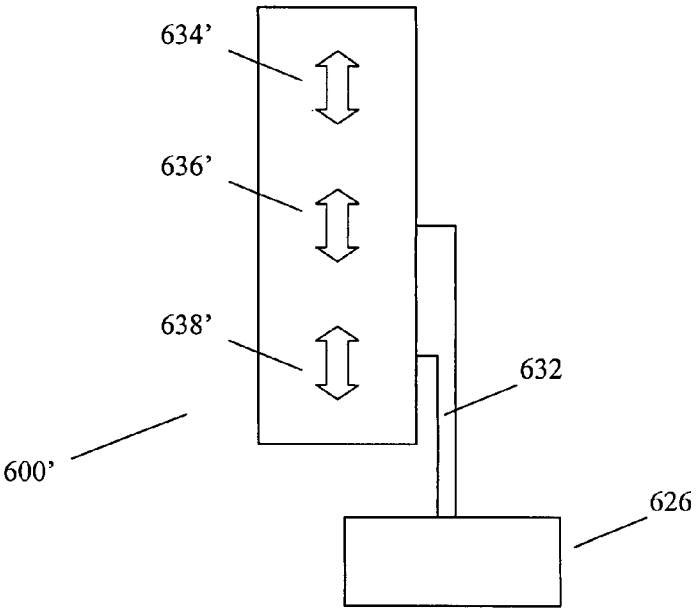
FIG. 6B shows linear array 600' as a schematic of array 600, where double ended arrows 634', 636', and 638' symbolize the three elements 634, 636, and 638.
Figure 6A:
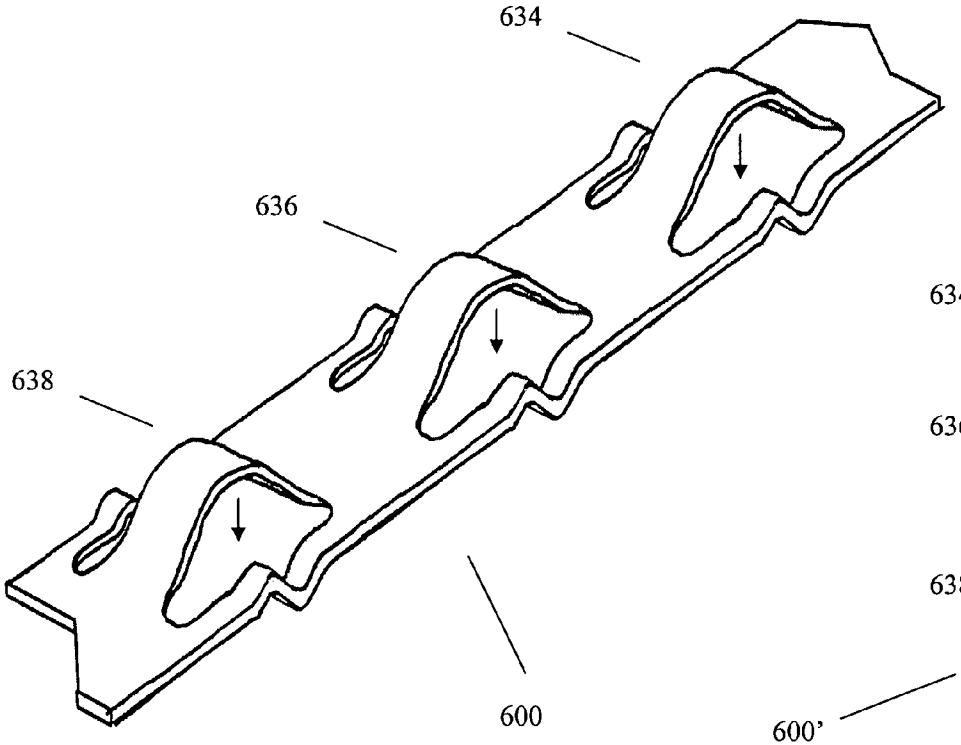
FIG. 6A is a drawing in perspective of a linear array 600 having three bistable mechanisms 634, 636, and 638 fabricated in a strip of flexible substrate 602.

FIG. 6A is a drawing in perspective of a linear array 600 having 3 bistable mechanisms 634, 636, and 638 fabricated in a strip of flexible substrate 602. For clarity, shape memory elements such as 110 are not shown. Each of the mechanisms in array 600 can be actuated independently. Two or more mechanism can be actuated to give a net force or net motion to array 600. For example, actuating the three mechanisms as in FIG. 6A can impart a force in the direction of the arrows shown.

FIG. 6B shows linear array 600' as a schematic of array 600, where double ended arrows 634', 636', and 638' symbolize the three elements 634, 636, and 638. As used herein, such double ended arrows can symbolize any actuator disclosed herein. Such arrays can be coupled by electrical leads 632 to controller 626. In preferred embodiments, the array can comprise a plurality of multiplexing diodes, whereby electrical leads can be shared among actuators, thus reducing the number of electrical leads compared to the number needed to address each actuator separately.

Figure 6C:
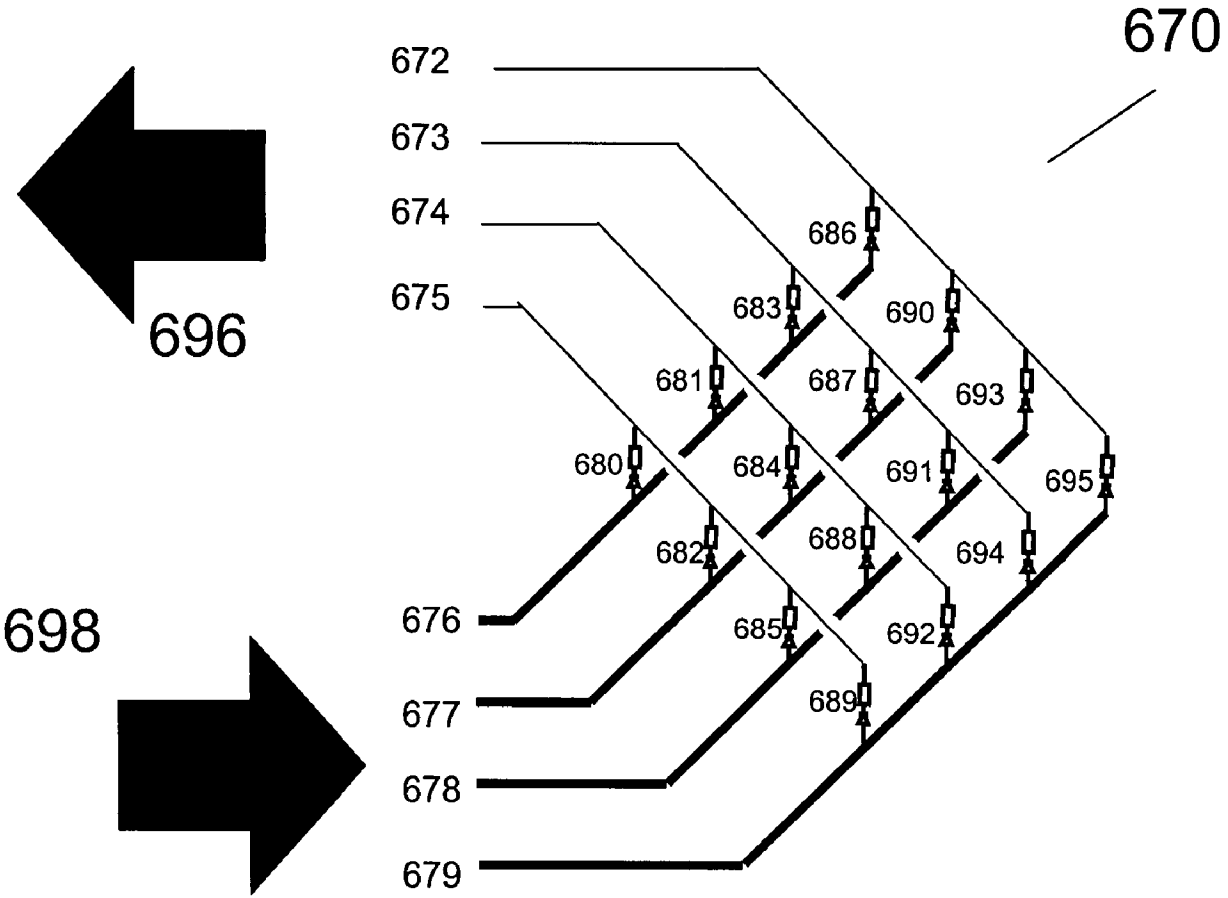
FIG. 6C is a general schematic 670 of a typical multiplexing arrangement, where for example, N^2 (N=4 in this example) elements are addressed by 2N lines 672-679.

FIG. 6C is a general schematic 670 of a typical multiplexing arrangement, where for example, N^2 (N=4 in this example) elements are addressed by 2N lines 672-679. N lines 672-675 can be employed for sourcing current and the other N lines 676-679 can be employed for sinking current. The shape memory element can be referred to by the intersection of the source and sink lines, for example, element 672/676, element 772/677, and the like. To trigger a single element (e.g., shape memory element 672/676), its source line can be activated (e.g., 672), and its sink line (e.g., 676) can be activated. Current can flow from 672 through desired shape memory element 672/676 to 676. The diodes associated with the elements (diodes 680-695, in this case diode 686) can prevent unintended current flow through neighboring resistors. The elements of the array can then be controlled by controller 626 as for actuator 501 in the description of FIG. 5B above.

Figure 7:
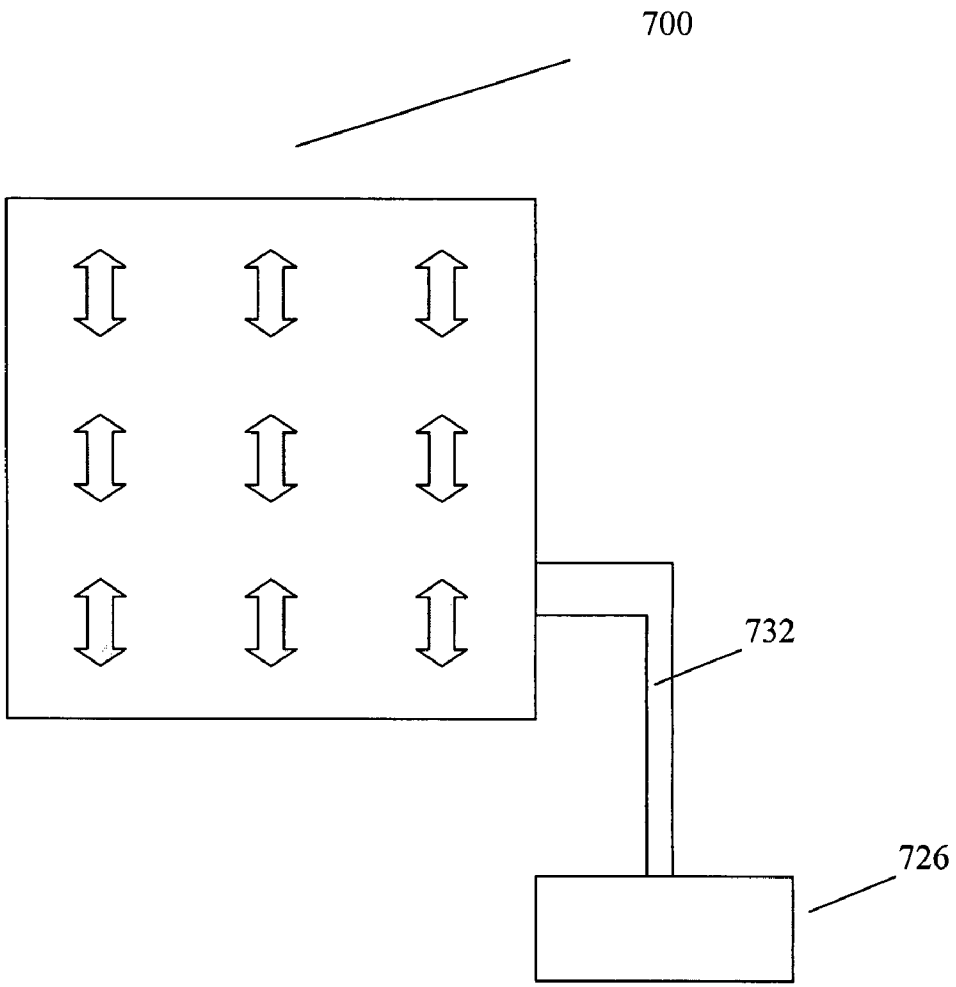
FIG. 7 is a schematic of a two dimensional array 700 having 9 elements.

FIG. 7 is a schematic of a two dimensional array 700 having 9 elements. As above, the elements can be any bistable mechanism or any actuator disclosed herein. Such arrays can be coupled by electrical leads 732 to controller 726, for example through one or more multiplexing diodes, e.g., diode 740. The elements can be addressed for independently controlled actuation by automated controller 726.

When bistable mechanisms or actuators are elements in an array, the elements can be the same or different in size, construction, mechanical characteristics, orientation, spacing, and the like. For example, in typical embodiments, such array elements are the same size, have the same mechanical characteristics, are oriented in the same direction, are regularly spaced on the array, as depicted in arrays 600 and 700 in FIGS. 6A and 7.

Figure 8:
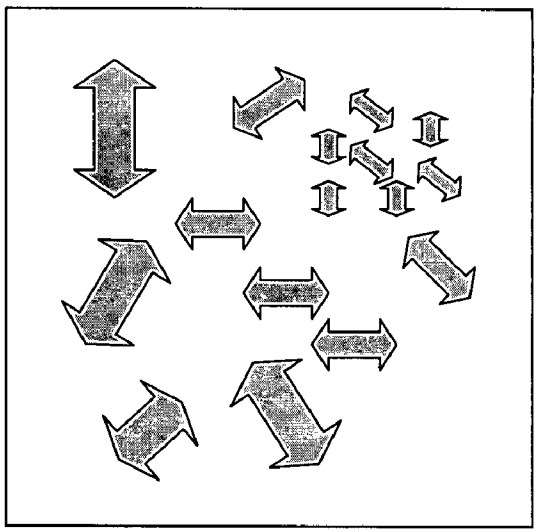
FIG. 8 is a schematic of a two dimensional array 800 where the individual elements, e.g., bistable mechanisms or actuators, can have different orientations with respect to each other, different force characteristics due to different sizes, and are spaced in an irregular array.

FIG. 8 is a schematic of a two dimensional array 800 where the individual elements, e.g., bistable mechanisms or actuators, can have different orientations with respect to each other, different force characteristics due to different sizes, and are spaced on an irregular array. These respective differences can be symbolized schematically in FIG. 8 by the orientation, size, and spacing of the double arrows.

FIG. 9 is a drawing of a method of manufacturing a shape memory element. A shape memory wire 942 and an adhesive substrate 944 (e.g., a substrate with a temporary or permanently curable adhesive layer, typically temporary, such as adhesive tape) can be wrapped on a spool 946 to create a layer of substantially physically parallel wire loops 948 adhered to adhesive substrate 944. The method can include wrapping adhesive substrate 944 on spool 946 and wrapping wire 942 on adhesive substrate 944 to contact wire 942 to the adhesive layer of adhesive substrate 944. Or, wire 942 can be wrapped on spool 946, and adhesive substrate 944 can be wrapped on wire 942 to contact the adhesive layer of adhesive substrate 944 to wire 942.

The wire can be wrapped on the spool at a desired pitch or loop spacing using, e.g., micro-controlled rotary and linear stages. The pitch or loop spacing can be set so that the ratio of the diameter of the wires divided by the distance between adjacent wire loops on the spool is less than about 1. The wires can include a shape memory alloy selected and sized as described above under FIG. 1. The tension on the wire can be set to prestrain the wires to a desired amount to facilitate the shape memory effect. For example, for NiTi wires, a prestrain of between about 0% and about 8% can be employed.

The combination of spooled wire 942 on adhesive substrate 944 can be removed from the spool 946 by cutting via a keyway 956 in the spool.

The method can include separating discrete shape memory wire elements 950, 950', 950" . . . by mechanical or laser cutting, preferably mechanical cutting. Discrete shape memory wire elements 950, 950', 950" . . . each include an array of substantially physically parallel shape memory wire segments 952 adhered to the adhesive substrate The adhesive layer of adhesive substrate 944 can be cured to create laminated shape memory element 910. Or, wire segments 952 of each discrete shape memory wire element 950 can be cured in a separately applied curable matrix (e.g., a polymer curable by exposure to radiation (light, heat, ultraviolet light, electron beam radiation) curing agents, catalysts, and the like) to create laminated shape memory element 910. For example, the wire element 950 can be aligned in a jig, at least a portion of the wire segments 952 can be embedded in a uncured adhesive matrix, which can be applied with a stencil; the adhesive can be cured; and the laminated shape memory element 910 can be released, optionally with solvent.

In another embodiment, adhesive substrate 944 can include a pattern that defines each discrete shape memory element, e.g., a pre-printed or pre-cut pattern that facilitates separating discrete shape memory wire elements 950, 950', 950" . . . . For example, the pattern can be an interdigitating pattern that can lead to less waste, as shown by dotted line 958. The pattern can preferably be laser cut. Moreover, the interdigitating pattern is cut, two interdigitating strips of adhesive substrate comprising discrete shape memory wire elements 950, 950', 950" are released. These interdigitating strips can be mounted on an alignment frame 960 which can facilitate alignment of the elements for application of the curable adhesive matrix to each element. After curing, individual laminated shape memory elements 910 can be separated and released. Or, alignment frame 960 can hold the discrete shape memory wire elements 950, 950', 950" and the uncured matrix in a position to contact an array of bistable mechanisms (e.g., arrays 600 and 700 in FIGS. 6A and 7). Upon contacting the array, the curable matrix can be cured and the adhesive substrate removed, leaving individual laminated shape memory elements 910 adhered to the bistable elements of the array.

Figure 10A:
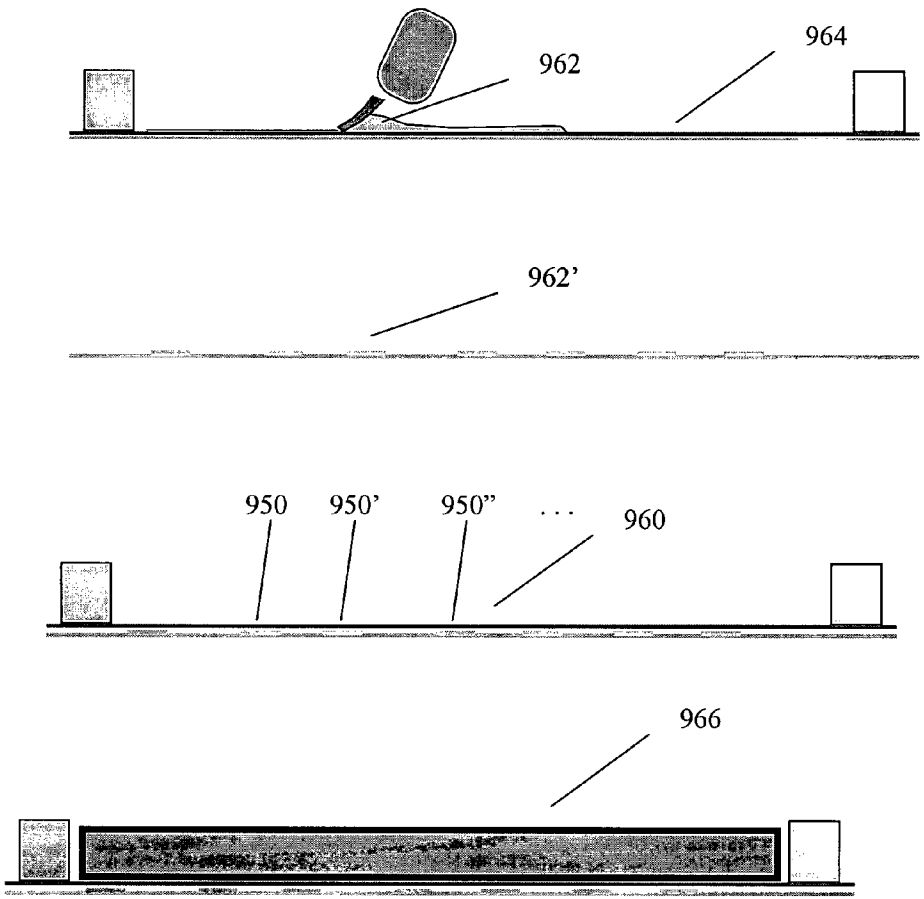
FIGS. 10A and 10B show steps that can be included in embedding shape memory elements 950 in a curable adhesive matrix 962.
Figure 10B:
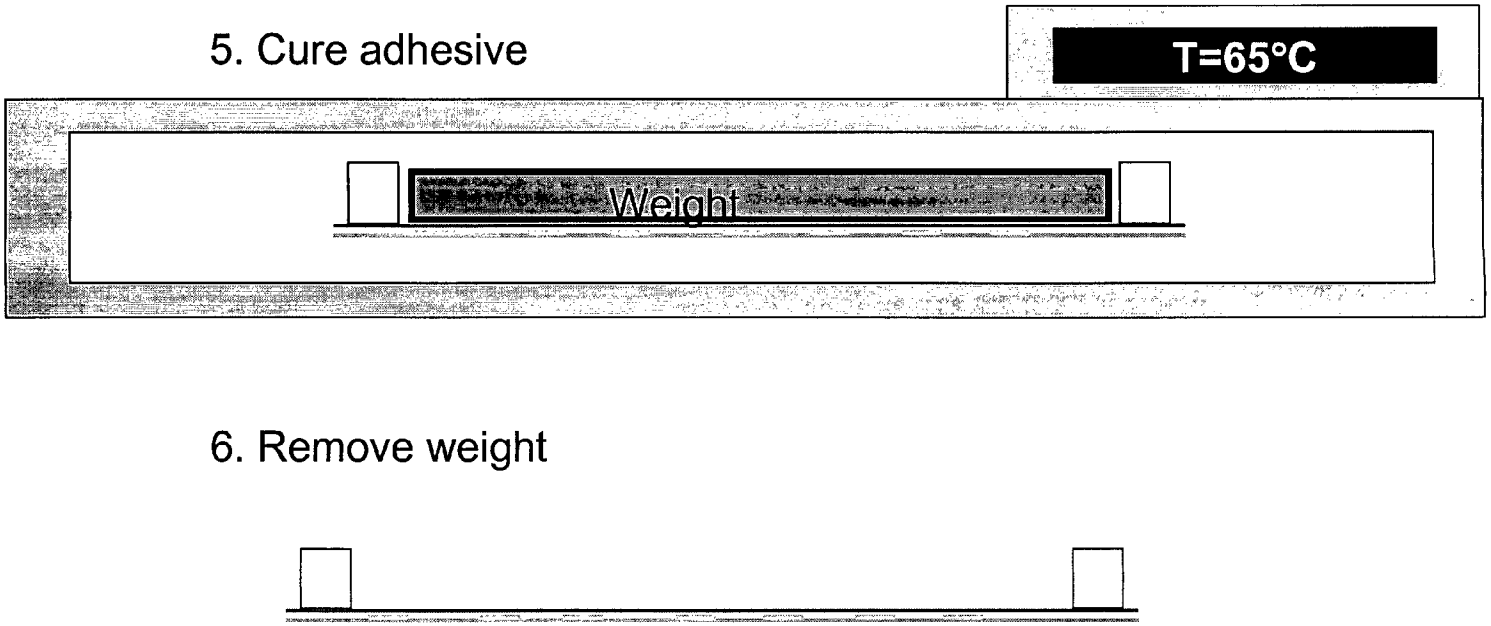

FIGS. 10A and 10B show steps that can be included in embedding shape memory elements 950 in a curable adhesive matrix 962. In step 1, curable adhesive matrix 962 can be screen printed, stenciled, or otherwise patterned using screen/stencil 964. In step 2, screen/stencil 964 can be removed. In step 3, the carriage tape alignment frame 960, which can be preloaded with shape memory elements/actuators 950, 950', 950" for positioning. In step 4, the shape memory elements/actuators 950, 950', 950" can be embedded into the stenciled adhesive matrix 962'. In step 5, stenciled adhesive matrix 962' can be cured, and the embedding pressure 966 removed. Other optional steps can be performed, for example, an insulating top-coat can be added, or the other side can be patterned by repeating steps 1-, the adhesive substrate (carriage tape) can be removed, e.g., with solvent; electrical traces can be wired or printed, for example, surface traces of conductive ink can be stenciled and cured; surface mount diodes can be located (e.g., using a stencil), placed, and cured; tension beams can be crimped; and the like.

While this invention has been particularly shown and described with references to preferred embodiments thereof, it will be understood by those skilled in the art that various changes in form and details may be made therein without departing from the scope of the invention encompassed by the appended claims.

What is claimed is:

1. An actuator array, wherein each actuator comprises:

a bistable mechanism including a tension beam and a deformed compression beam separated by a relief slit in a flexible substrate, the compression beam being deformed with a central region displaced in a transverse direction from the flexible substrate at the beam ends; and a first shape memory element mechanically coupled to the bistable mechanism that upon heating exerts a force that actuates the deformed compression beam from a first stable position on one side of the substrate to a second stable position on an opposite side of the substrate, the first shape memory element comprising at least two substantially parallel shape memory alloy wires electrically coupled in series to the electrical leads.

2. The actuator array of claim 1, wherein the first shape memory element comprises a shape memory alloy, a bimetallic strip, or a thermally-actuated shape memory polymer.

3. The actuator array of claim 1, further comprising electrical leads coupled to the first shape memory element, whereby the first shape memory element is heated by application of electrical current.

4. The actuator array of claim 1, further comprising a first heat source thermally coupled to the first shape memory element.

5. The actuator array of claim 4, further comprising a second heat source thermally coupled to a second shape memory element at each bistable mechanism that heats the second shape memory element to exert a force that actuates the bistable mechanism from the second position to the first position.

6. The actuator array of claim 5, wherein each shape memory element comprises a laminated array of substantially parallel shape memory alloy wires.

7. The actuator array of claim 6, wherein the wires comprise a shape memory alloy selected from the group consisting of NiTi, CuZnAl, and CuAlNi.

8. The actuator array of claim 7, wherein the wires are NiTi.

9. The actuator array of claim 7 wherein the shape memory wires have a diameter of less than about 500 micrometers.

10. The actuator array of claim 9 wherein the ratio of the diameter of the wires divided by the distance between adjacent wires is less than about 1.

11. The actuator array of claim 10 wherein each actuator operates in air at 25° C at a frequency of at least about 2 cycles per second.

12. The actuator array of claim 1 wherein the tension beam comprises a permanent out-of-plane deformation.

13. The actuator array of claim 1 wherein each shape memory element is coupled to the compression beam to convert the displacement of each shape memory element into a greater displacement at the compression beam.

14. The actuator array of claim 1 further comprising a second tension beam defined by a second relief slit, wherein the beams and the slits are substantially parallel.

15. The actuator array of claim 1, wherein the flexible substrate is in the form of a tape comprising the array of actuators as a linear array.

16. The actuator array of claim 1, wherein the flexible substrate is in the form of a sheet comprising the array of actuators as a two-dimensional array.

17. The actuator array of claim 1 wherein the flexible substrate comprises a material selected from the group consisting of steel alloy, phosphor bronze alloy, aluminum alloy, titanium alloy, carbon fiber/epoxy composite, fiberglass/epoxy composite, Kevlar/epoxy composite, polyimide, polyamide, polyester, polyvinylidene fluoride, polypropylene, polyethylene, and urethane.

18. The actuator array of claim 4, wherein the first shape memory element comprises a bimetallic layer.

19. The actuator array of claim 4, wherein the actuators are adapted for automatic control.

20. The actuator array of claim 19, further comprising one or more multiplexing diodes to independently control each actuator.

21. The actuator array of claim 20, further comprising an open loop automated controller coupled to the actuators.

22. A method of operating an actuator array, wherein each actuator comprises:

a bistable mechanism including a tension beam and a compression beam separated by a relief slit in a flexible substrate, the compression beam being deformed with a central region displaced in a transverse direction from the flexible substrate at the beam ends; and a first shape memory element mechanically coupled to the bistable mechanism;

the method comprising the step of automatically, independently controlling each actuator by heating the first shape memory element to exert a force that actuates the deformed compression beam from a first stable position on one side of the substrate to a second stable position on an opposite side of the substrate, the first shape memory element comprising at least two substantially parallel shape memory alloy wires electrically coupled in series to the electrical leads.

23. The method of claim 22, further comprising passing electrical current through the first shape memory element to heat each shape memory element.

24. The method of claim 22, further comprising heating the first shape memory element with a heat source coupled to each shape memory element.

25. The method of claim 22, further comprising heating a second heat source thermally coupled to a second shape memory element at each actuator to exert a force that actuates the bistable mechanism from the second position to the first position.

26. The method of claim 25, further comprising deactivating the heat sources after actuating each actuator.

27. The method of claim 25, wherein the first shape memory element is mechanically coupled to the compression beam, further comprising controlling the displacement of the first shape memory element to give a greater displacement at the compression beam.

28. The method of claim 25, further comprising operating the actuators at a frequency at 25° C. in air of at least about 2 cycles per second.

29. The method of claim 25, wherein the first shape memory element comprises a bimetallic layer.

* * * * *

UNITED STATES PATENT AND TRADEMARK OFFICE

CERTIFICATE OF CORRECTION

PATENT NO. : 7,665,300 B2
APPLICATION NO. : 11/078195
DATED : February 23, 2010
INVENTOR(S) : Biggs et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1317 days.

Signed and Sealed this

Twenty-eighth Day of December, 2010

David J. Kappos

David J. Kappos
*Director of the United States Patent and Trademark Office*